US008016138B2

(12) United States Patent
Jacobson

(10) Patent No.: US 8,016,138 B2
(45) Date of Patent: Sep. 13, 2011

(54) HANGER RETAINER DEVICE, SYSTEM, AND METHODS FOR RETAINING HANGERS ON A ROD

(75) Inventor: Kenneth E. Jacobson, Owatonna, MN (US); Dorothy Ann Jacobson, legal representative, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 452 days.

(21) Appl. No.: 12/246,108

(22) Filed: Oct. 6, 2008

(65) Prior Publication Data

US 2009/0139945 A1 Jun. 4, 2009

Related U.S. Application Data

(60) Provisional application No. 60/977,812, filed on Oct. 5, 2007.

(51) Int. Cl.
*A47F 5/08* (2006.01)

(52) U.S. Cl. ..... 211/113; 211/124

(58) Field of Classification Search ..... 211/124, 211/85.3, 113, 117, 118, 119.004, 123, 106.01, 211/105.1; 248/308, 215, 339; D6/315, D6/317, 323, 326, 328; 223/85–98; D8/300, D8/367

See application file for complete search history.

(56) References Cited

U.S. PATENT DOCUMENTS

| | | | | |
|---|---|---|---|---|
| 2,685,962 A | | 8/1954 | Druth | |
| 2,868,390 A | | 1/1959 | McCrone | |
| 3,021,958 A | | 2/1962 | Winkler | |
| 4,296,959 A | | 10/1981 | Helbig | |
| D264,904 S | | 6/1982 | Helbig | |
| 4,415,093 A | | 11/1983 | Livingston | |
| 4,762,238 A | * | 8/1988 | Blanchard | 211/123 |
| 4,824,156 A | | 4/1989 | Greene | |
| 5,139,298 A | | 8/1992 | Dowell | |
| 5,294,005 A | * | 3/1994 | Hedges | 211/85.7 |
| 5,480,193 A | * | 1/1996 | Echols et al. | 285/45 |

(Continued)

FOREIGN PATENT DOCUMENTS

JP 9038387 A 2/1997

OTHER PUBLICATIONS

U.S. Appl. No. 29/325,779, filed Oct. 6, 2008, Jacobson.

(Continued)

*Primary Examiner* — Jennifer E. Novosad
(74) *Attorney, Agent, or Firm* — Patterson Thuente Christensen Pedersen, P.A.

(57) ABSTRACT

A hanger retainer for securing hangers to a garment-supporting rod. The hanger retainer generally includes first and second side portions spaced apart from each other, a hooked portion extending from at least one of the side portions, and first and second retaining portions extending between the side portions. The hooked portion is designed to hook around a garment-supporting rod such that the first retaining portion is spaced a first distance from the rod, and the second retaining portion is spaced a second distance less than the first distance from the rod. The hanger retainer is rotated about the rod from a first position in which a hanger is received between the side portions on the hanger rod, and a second position in which the hanger is secured to the rod, thereby enabling transport one or more hangers on the rod without concern that the hangers may fall from the rod.

20 Claims, 7 Drawing Sheets

U.S. PATENT DOCUMENTS

| | | | | |
|---|---|---|---|---|
| 5,492,295 | A * | 2/1996 | Remmers | 248/251 |
| D383,910 | S | 9/1997 | Maxwell | |
| 5,758,851 | A * | 6/1998 | Remmers | 248/251 |
| 5,868,369 | A | 2/1999 | Montgomery | |
| D414,967 | S | 10/1999 | Richter | |
| 6,223,915 | B1 | 5/2001 | Waner | |
| 6,273,376 | B1 | 8/2001 | Montgomery | |
| 6,488,159 | B2 * | 12/2002 | Shuen | 211/123 |
| D478,499 | S | 8/2003 | Winig et al. | |
| 6,719,156 | B2 * | 4/2004 | Ellbogen et al. | 211/105.1 |
| 6,948,628 | B1 * | 9/2005 | Sahlem | 211/124 |
| D533,362 | S | 12/2006 | Giampavolo | |
| D535,111 | S | 1/2007 | Giampavolo | |
| D536,539 | S | 2/2007 | Chen | |
| D576,475 | S * | 9/2008 | Didehvar | D8/373 |
| D581,682 | S | 12/2008 | Madlinger | |
| 2009/0173859 | A1 * | 7/2009 | Didehvar | 248/261 |
| 2011/0017891 | A1 * | 1/2011 | Didehvar | 248/261 |

OTHER PUBLICATIONS

Notice of Allowance dated Sep. 3, 2010 and Issue Notification dated Sep. 15, 2010 for U.S. Appl. No. 29/325,779, filed Oct. 6, 2008.

* cited by examiner

FIG. 1
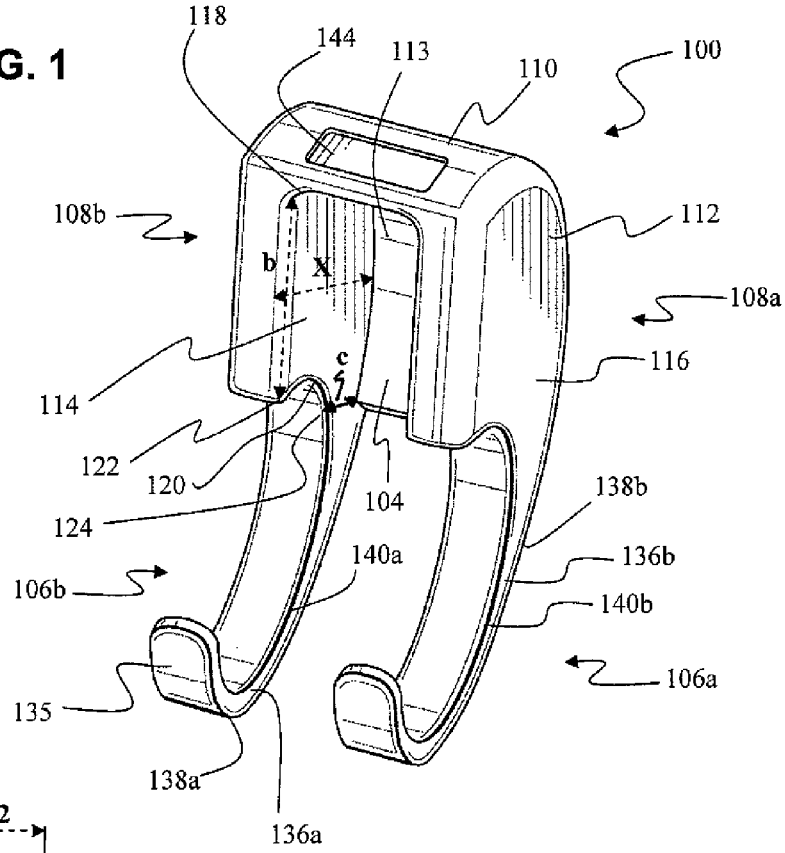
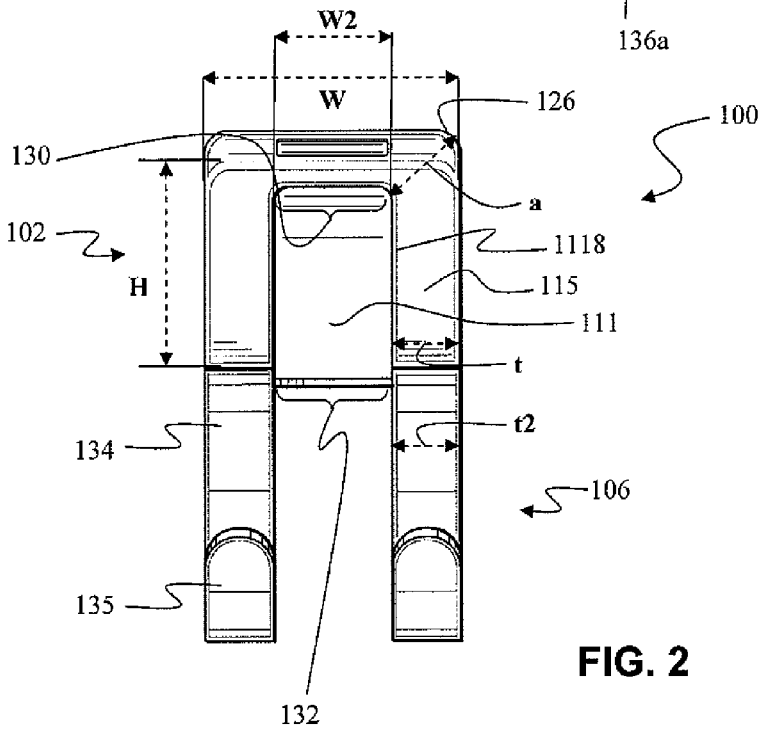
FIG. 2

FIG. 3
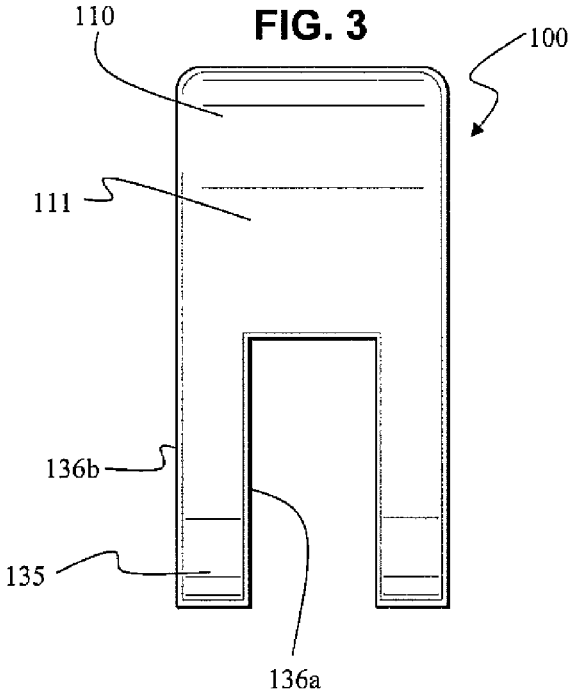
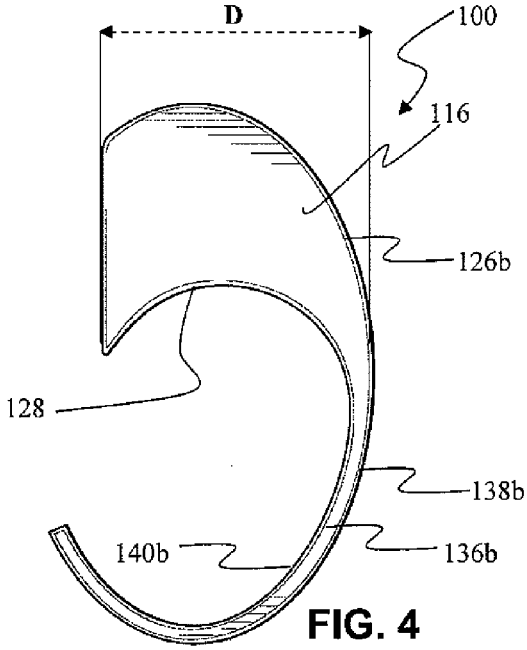
FIG. 4
FIG. 5
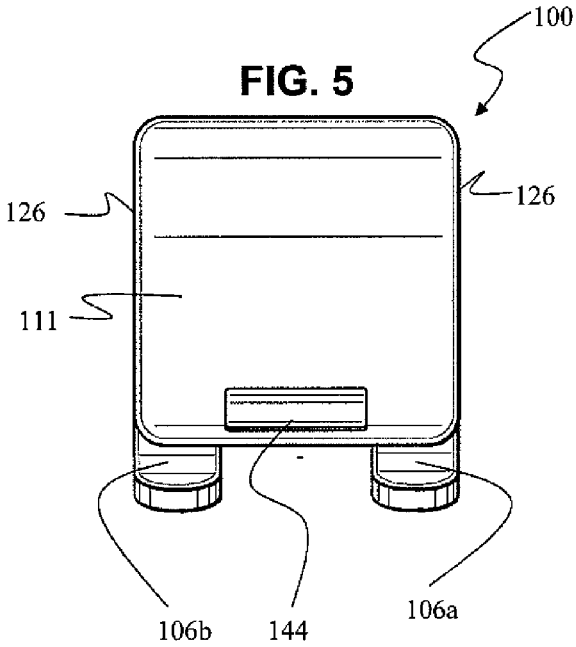
FIG. 6
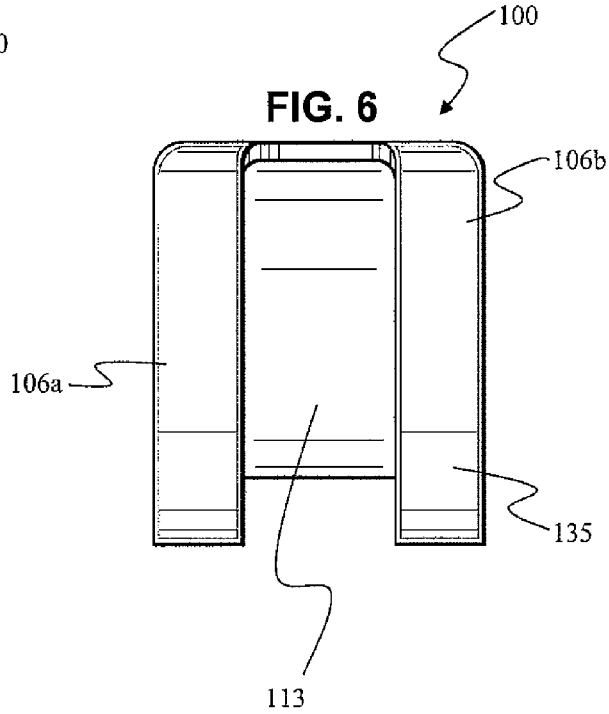

HANGER RETAINER DEVICE, SYSTEM, AND METHODS FOR RETAINING HANGERS ON A ROD

RELATED APPLICATION

The present application claims the benefit of U.S. Provisional Application No. 60/977,812 filed Oct. 5, 2007, which is incorporated herein in its entirety by reference.

FIELD OF THE INVENTION

The present invention relates generally to hanger retainers. More particularly, the invention relates to a device, system, and method for retaining hangers on a garment-supporting rod, particularly during transport.

BACKGROUND OF THE INVENTION

Hangers are commonly used to facilitate the hanging or draping of various garments, including items of clothing such as coats, jackets, shirts, and pants, tablecloths, sheets, and the like. Hanging garments, as opposed to folding them, helps to prevent the occurrence of wrinkles and can also facilitate the aeration of the garment. Hangers generally can comprise two shapes: human shoulder and clamp. Human shoulder shaped hangers are designed for use with jackets, shirts, and blouses, while clamp hangers are designed to hang skirts and pants. The materials with which hangers are made include wire, plastic, and wood.

Clothes hangers work by placing apparel on the shoulders of the hanger, fastening the apparel to the clamps on the hanger, or draping a garment over a horizontal member of the hanger, and placing a hook-shaped portion of the hanger over a garment-supporting rod. Such garment-supporting rods may be in closets, garment racks including mobile garment racks, dry cleaning facilities, or industrial laundry facilities. Oftentimes, because of the shape of the hook portion of the hanger and excessive movement, hangers may fall from garment-supporting rods. This may especially be a concern where large amounts of garments on hangers must be transported from one location to another, such as at dry cleaners or industry laundry facilities.

To address the need to secure hangers to a garment-supporting rod, various types of support structures have been developed. Some examples of hanger securing structures are disclosed in the following patents: U.S. Pat. No. 5,139,298 to Dowell; U.S. Pat. No. 3,021,958 to Winkler; U.S. Pat. No. 6,223,915 to Warner; and Japanese Publication No. 09038387 to Tanmachi Toshiyuki, all of which are incorporated herein by reference. However, none of these references disclose a hanger retainer that individually secures each hanger to a garment-supporting rod to prevent the hanger from falling from the garment-supporting rod and from shifting along the rod during transport.

There remains a need for an improved hanger retainer, system, and method for securing hangers on garment supporting rods such that the hangers do not fall off of the rod and do not shift along the rod during transport.

SUMMARY OF THE INVENTION

Various embodiments of the present invention are directed to a device, system, and method for retaining individual hangers on a garment-supporting rod. The hanger retainer of the present invention allows apparel to be removed from a hanger without concern that the hanger may fall from the garment-supporting rod. The hanger retainer allows transport of one or more hangers on portable garment-supporting rods, such as the rod of a laundry cart or garment rack, without concern that the hanger or hangers may fall from the garment-supporting rods. The hanger retainer further allows the user to secure hangers individually on the rod rather than collectively.

In various embodiments of the invention, the hanger retainer generally includes a first side portion spaced apart from an opposing second side portion, a hooked portion extending from at least one of the first and second side portions, a first retaining portion and a second retaining portion. Each side portion includes a body portion having an external face and an internal face. The internal face is bound by an outer edge, and an arcuate inner edge spaced from the outer edge, the arcuate inner edge having a first end and a second end spaced apart along the arcuate inner edge.

The first and second retaining portions extend between the internal face of the first side portion and the internal face of the second side portion. The first retaining portion is spaced radially outward from the first end of the arcuate inner edge of the internal face of each side portion by a first retaining distance, and the second retaining portion is spaced radially outward from the second end of the arcuate inner edge of the internal face of each side portion by a second retaining distance, the first retaining distance being greater than the second retaining distance.

The hooked portion presents a continuing arcuate edge that extends from the arcuate inner edge along a continuing arcuate shape such that the arcuate inner edge and the continuing arcuate edge together define an arc greater than one hundred eighty degrees, and more particularly between two hundred ten and two hundred fifty degrees. The hooked portion is resilient and the arcuate shape is at a radial distance from a center point of the arc such that the arcuate inner edge and the hooked portion together can grippingly receive a hanger rod within.

The hanger retainer is shiftable between a first position in which a hook portion of a hanger is removably receivable on a hanger rod between the first side and the second side of the hanger retainers, and a second position in which the first retaining portion and the second retaining portion inhibit movement of the hanger from the hanger rod.

A system for retaining hangers on a hanger rod generally includes a hanger rod, a hanger; and a hanger retaining device. The hanger retaining device includes a body portion having a first side portion and a second side portion spaced apart from each other, a hooked portion extending from at least one of the first and second side portions that can be positioned on the hanger rod, a first retaining portion spaced radially at a first retaining distance from the hanger rod and extending between the first and second side portions, and a second retaining portion spaced radially at a second retaining distance from the hanger rod and extending between the first and second side portions, wherein the first retaining portion is greater than the second retaining portion. The body portion presents structure defining a cavity, the cavity being bound by the first and second side portions, the first and second retaining portions, and the hanger rod.

The hanger retaining device of the system is shiftable between a first position in which the hanger is removably receivable within the cavity on the hanger rod, and a second position in which the hanger is retained on the hanger rod by the first retaining portion and the second retaining portion such that lateral and vertical movement of the hanger on the hanger rod is inhibited.

A method of retaining a hanger on a hanger rod includes providing a hanger retaining device having a body portion comprising a first side portion and a second side portion spaced apart from each other, a hooked portion extending from at least one of the first and second side portions that can be positioned on a hanger rod, a first retaining portion spaced radially at a first retaining distance from an inner edge of each side portion and extending between the first and second side portions, and a second retaining portion spaced radially at a second retaining distance from the inner edge of each side portion, and extending between the first and second side portions, wherein the first retaining distance is greater than the second retaining distance. The body portion presents structure defining a cavity bound by the first and second side portions, and the first and second retaining portions.

The hanger retaining device is positioned on a hanger rod by the hooked portion such that the cavity is further bound by the hanger rod. A hook-shaped portion of a hanger is inserted into the cavity and onto the hanger rod. The hanger retaining device is then shifted from a first position in which the hanger is removably receivable within the cavity on the hanger rod, to a second position in which the hanger is retained on the hanger rod by the first retaining portion and the second retaining portion such that the hanger is secured to the hanger rod. The hanger cannot be removed from the hanger rod until the hanger retaining device is shifted from the second position to the first position.

The above summary of the invention is not intended to describe each illustrated embodiment or every implementation of the present invention. The figures and the detailed description that follow more particularly exemplify these embodiments.

BRIEF DESCRIPTION OF THE DRAWINGS

FIG. 1 is a front perspective view depicting a hanger retainer according to one embodiment of the present invention;

FIG. 2 is a front view depicting the hanger retainer of FIG. 1;

FIG. 3 is a rear view depicting the hanger retainer of FIG. 1;

FIG. 4 is a side view depicting the hanger retainer of FIG. 1;

FIG. 5 is a top view depicting the hanger retainer of FIG. 1;

FIG. 6 is a bottom view depicting the hanger retainer of FIG. 1;

Figure 7:
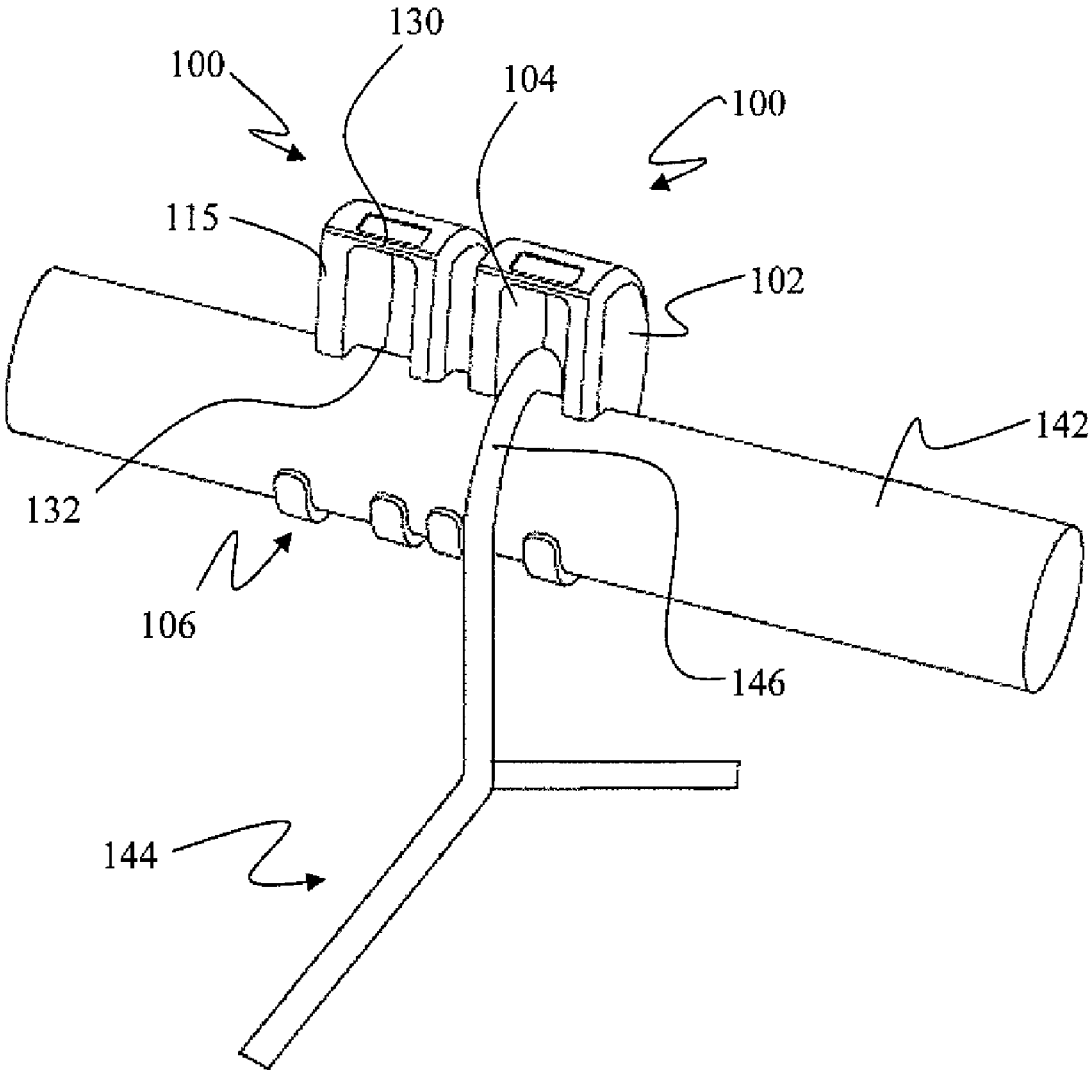
FIG. 7 is a perspective view of the hanger retainer of FIG. 1 on a garment-supporting rod wherein a hanger has been placed in the hanger cavity between the hanger retainer and the garment-supporting rod.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

Referring to the drawings, and particularly to FIG. 1, a hanger retainer 100 generally can comprise a body portion 102, a hanger cavity 104, and a hook assembly 106. Hanger retainer 100 can be comprised any of a variety of suitable materials such as, for example, plastics such a polyethylene or polypropylene, metal, wood, and combinations thereof.

More particularly, referring to FIGS. 1 and 2, hanger cavity 104 is bound by first side portion 108*a* and second side portion 108*b* spaced from first side portion 108*a*, and an optional rear panel or wall 110. Hanger cavity 104 is further bound by a hanger rod when hanger retainer 100 is positioned on hanger rod 142, as depicted in FIG. 7.

Each side portion 108 includes a body portion 112. Body portion 112 can comprise an internal face 114 and an external face 116, spaced apart by a thickness "t", forming a front face 115. Referring to FIG. 2 particularly, front face 115 generally extends a distance "H" to define a height of body portion 112. Referring to FIG. 3, external faces 116 extend a distance "D" to define a width of body portion 112. Referring back to FIG. 2, external faces 116 of side portions 108*a* and 108*b* are spaced apart by a distance "W" and internal faces 114 of side portions 108*a* and 108*b* are spaced apart by a distance "W2". The difference between "W" and "W2" is thickness "t".

Referring to FIG. 1, internal face 114 is bounded by an outer edge 118 and an inner edge 120. Outer edge 118 can be any of a variety of suitable shapes, such as, for example, a curved or arcuate outer edge, straight-lined or squared edge, circular edge, or other suitable shaped edges. Inner edge 120 is generally curved or arcuate, which can include both circular and non-circular shapes. Inner edge 120 includes a first end 122 spaced apart along inner edge 120 from a second end 124.

Referring to FIG. 4, external face 116 is also bounded by an outer edge 126 and an inner edge 128. Outer edge 126 can be of similar shape or different from outer edge 118, and can be parallel to and/or slightly offset from outer edge 118 at least along a portion of outer edge 126. In one embodiment of the invention, as depicted in FIG. 2, outer edge 126 extends a distance "a" outwardly from outer edge 118 along a potion of outer edge 126, and is parallel to outer edge 118 along a different portion of outer edge 126.

Inner edge 128 can be of similar shape or different from inner edge 120, and can be parallel to and/or slightly offset from inner edge 120 at least along a portion of inner edge 120. In one embodiment of the invention, as depicted in FIG. 1, inner edge 120 is substantially parallel to inner edge 128 along substantially an entirety of inner edge 120.

Referring to FIGS. 1 and 2, a first retaining portion 130 extends radially at a distance "b" from first end 122 of inner edge 120, and a second retaining portion 132 extends radially at a distance "c" from second end 124 of inner edge 120. Distance "b" is greater than distance "c".

In an embodiment, depicted in FIGS. 1-4, hook assembly 106 can comprise a first hooked portion 106*a* extending from first side 108*a*, and second hooked portion 106*b* extending from second side 108*b*. In an alternative embodiment of the invention not shown, more or less than two hooked portions 106 are contemplated. Hooked portions 106*a* and 106*b* can comprise any of a variety of suitable shapes adapted to be secured to a garment-supporting rod 108, such as a circular or semi-circular form. Hooked portions 106*a* and 106*b* can be continuously formed with body portion 102, or can be a separate structure secured by fastening means such as, for example, adhesive, nails, screws, and the like to body portion 102. Hooked portions 106*a* and 106*b* can comprise the same or different material as body portion 102.

As illustrated in the FIGS. 1-4 and 6, each hooked portion 106 has a generally smooth, arcuate front face 134 and a substantially parallel rear face 135, both extending a thickness "t2" between internal side faces 136*a* and external side face 136*b*. In one embodiment of the invention, depicted in FIG. 2, thickness "t2" is substantially equal to thickness "t". In alternative embodiments not shown, thickness "t2" can be greater or less than thickness "t". Internal side face 136*a* is bound by arcuate outer edge 138*a* and arcuate inner edge 140*a*, and external side face 136*b* is bound by arcuate outer edge 138*b* and arcuate inner edge 140*b*.

In one embodiment of the invention, as shown in the figures, inner edge 140*a* comprises a continuing edge extending from second end 124 of inner edge 120, such that inner edge 140*a* and inner edge 120 together define an arc greater than about one hundred eighty degrees and less than about two hundred seventy degrees, and more particularly, from about two hundred ten degrees to about two hundred fifty degrees. The arc must be of sufficient size, or radius if circular, and the hooked potions 106 must be sufficiently flexible, yet resilient such that hook assembly 106 can grip the hanger rod within the arc, while allowing for rotation about the hanger rod only with accompanying force.

In an alternative embodiment of the invention, not shown, inner edge 140*a* comprises a continuing edge extending from first end 122 of inner edge 120 to define the arc described above.

As illustrated FIG. 1, outer edge 138*a* can also extend continuously from outer edge 118.

Referring to FIGS. 1 and 4, inner edge 140*b* and outer edge 138*b* extend from inner edge 128 and outer edge 126, respectively, such that a general C-shape or comma shape is formed. Side faces 136 can be substantially similar in shape to each other.

Referring to FIGS. 1-3 and 5, optional rear portion 110 can extend a distance "H" substantially along outer edges 118 and 126, to form a continuous top and back panel along body portions 112, between side portions 108. Rear portion 110 generally comprises an external face 111 and an internal face 113, and has a thickness extending between external face 111 and internal face 113. Internal face 113 generally extends between internal faces 114 of side portions 108, bounded by first retaining portion 130 and second retaining portion 132, such that cavity 104 is bound by at least a portion of internal faces 114 and internal face 113.

External face 111 of rear portion 110 extends along outer edge 126 of external face 116, substantially parallel to internal face 113, as shown in FIGS. 1, 3, and 5. External face 111 extends continuously from rear surface 135 of one or more hook portions 106.

Rear portion 110 can have a continuous thickness, or a variable thickness along distance "H", to further define cavity 104. In one embodiment, as shown in FIG. 1, hanger cavity 104 can extend at least fifty percent of the distance "D", at least fifty percent of the distance "W", and at least fifty percent of the distance "H" of body portion 112. As depicted in FIGS. 1 and 2, hanger cavity 104 is centered on body portion 102 and extends between first hooked portion 106*a* and second hooked portion 106*b*.

Figure 10:
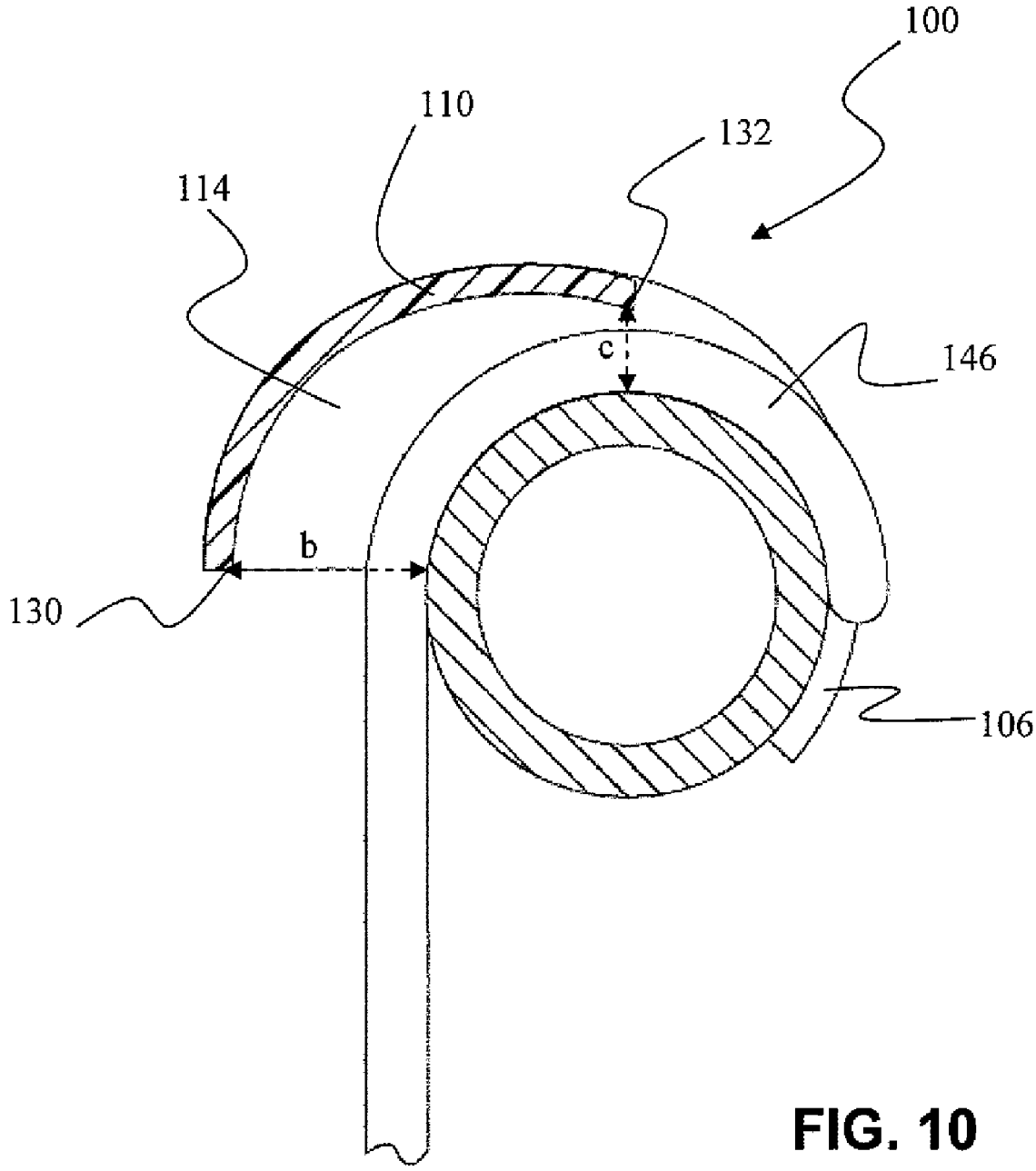
FIG. 10 is a section view taken at reference line 5-5 of FIG. 9.

In some embodiments, depicted in FIG. 1, rear portion 110 comprises a variable thickness such that hanger cavity 104 extends at a variable distance "X" along height "H" of body portion 112. In one embodiment, the value of distance "X" at a bottom edge of rear portion 110 corresponds to distance "c" extending from second end 124 of inner edge 120, and increases along height "H" of body portion 112. This variable distance "X" functions such that hanger retainer 100 can be rotated from a maximum clearance such that a hanger can be received within cavity 104 and onto a hanger rod, to a minimum "close" fit depending on the amount of rotation about garment-supporting rod 142, as depicted in FIG. 10.

As depicted in FIG. 5, external face 111 of rear portion 110 can further comprise a portion or tab 144 for numbering, labeling, or marking each hanger retainer 100 for easy location and identification. In one embodiment of the invention, tab 144 is a recess of finger tab for easy rotation of hanger retainer 100 about hanger rod 142. In an alternative embodiment, portion 144 can comprises an RFID chip, IR sensor, barcode, or other such technology for identification and location purposes. In yet another alternative embodiment, portion 144 can be formed on one or more external faces 116 of side portions 108.

In use, as shown in FIG. 7, hook assembly 106 is first positioned by a user so that hook assembly 106 clips or grips onto hanger rod 142 and body portion 112 is directly above hanger rod 142 such that hanger cavity 104 is exposed. Upon placement of hanger retainer on a garment-supporting rod or hanger rod 142, cavity 104 is further bound by hanger rod 142, leaving only front access to cavity 104 when hanger retainer is positioned on hanger rod 142 such that body portion 102 is above hanger rod 142.

The user then places a clothes hanger 144 on hanger rod 142 in a first position so that a hook-shaped portion 146 of hanger 144 fits into hanger cavity 104 and at least partially around hanger rod 108. First retaining portion 130, substantially flush with front face 115, is located above hanger rod 142 in this first position, and second retaining portion 132 is located approximate ninety degrees from first retaining portion 130. First retaining portion 130 can be of a sufficient distance "b" from hanger rod 142 to allow insertion of hook-shaped portion 146 with relative ease. In one embodiment of the invention, first hooked portion 106*a* and second hooked portion 106*b* of hook assembly 106 are on either side of hook-shaped portion 146 of hanger 144.

Figure 8:
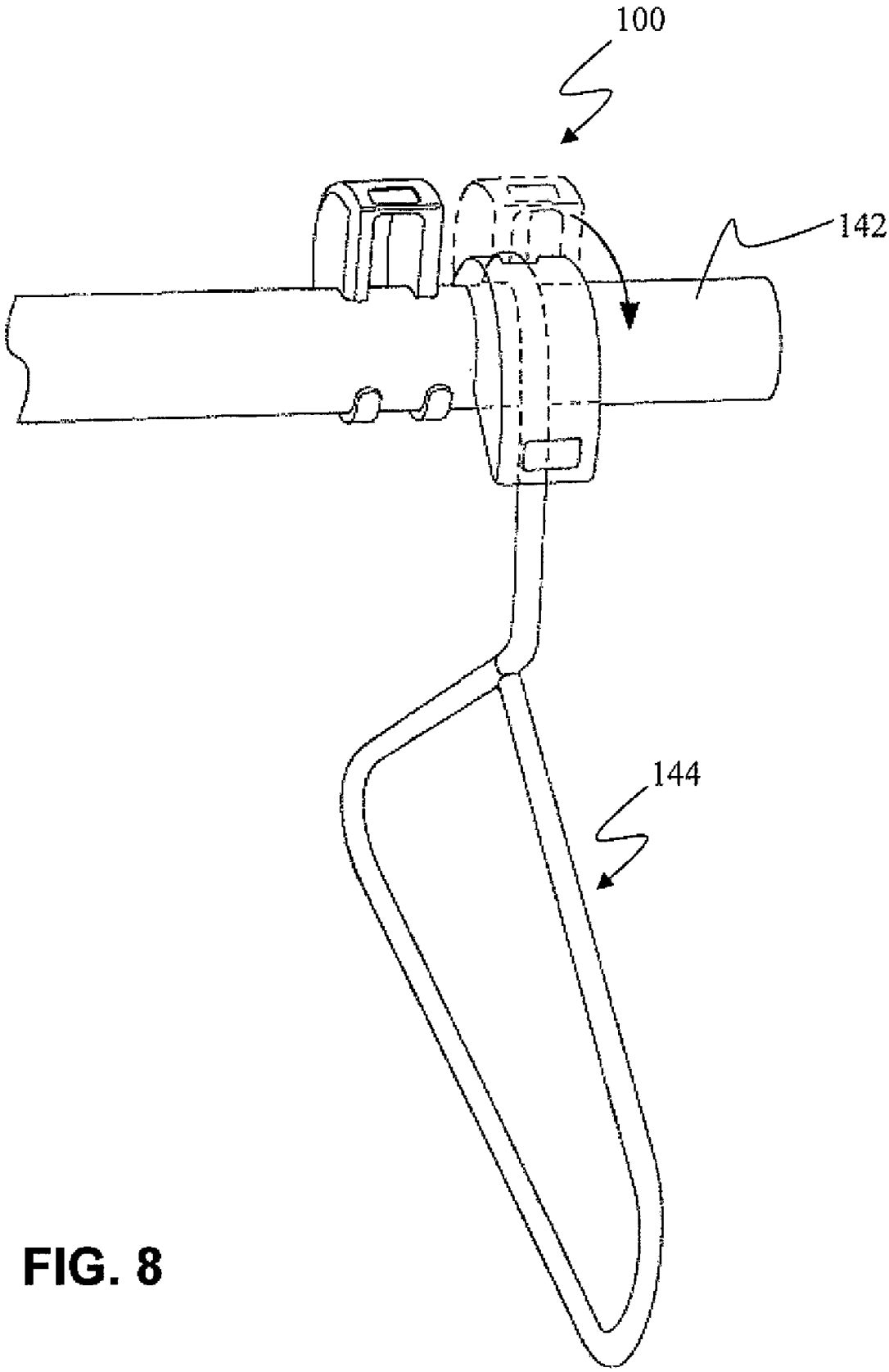
FIG. 8 is a perspective view of the hanger retainer, hanger, and garment-supporting rod of FIG. 7 wherein the hanger retainer is rotated to secure the hanger to the garment-supporting rod.
Figure 9:
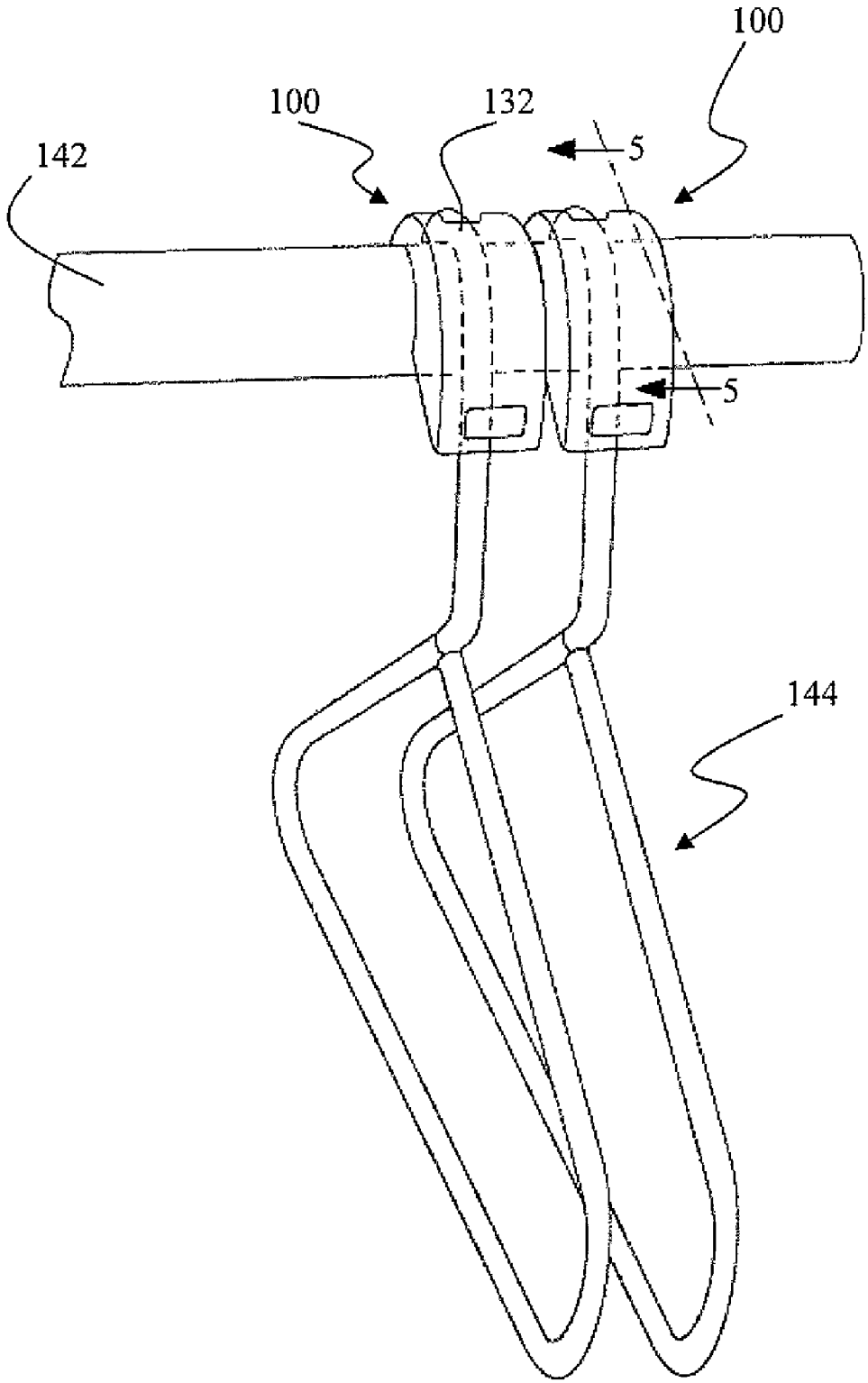
FIG. 9 is a perspective view according to one embodiment of the invention of a plurality of hangers secured to a garment-supporting rod.

As illustrated in FIGS. 8 and 9, to secure hanger 144 onto hanger rod 142, hanger retainer 100 is shifted or rotated about garment-supporting rod 142 to a second position in which hook assembly 106 stays secured to hanger rod 142. In one embodiment of the invention, hanger retainer 100 is shifted or rotated approximately ninety degrees such that second retaining portion 132 is now located above hanger rod 142.

As shown in FIG. 9, hanger 144 is secured to hanger rod 142 by retaining portions 130 and 132. Second retaining portion 132 can be of a distance "c" from hanger rod 142 to create a close fit or snug fit of hook-shaped portion 146 between second retaining portion 132 and hanger rod 142 such that hanger 144 cannot be removed from hanger rod 142 by movement in a vertical direction. For example, distance "c" is slightly greater than a thickness of hook-shaped portion 146, as shown in FIG. 10. First retaining portion 130 inhibits or prevents hanger 144 from being removed from hanger rod 142 by movement in a lateral direction.

Referring back to FIG. 8, in this second position, hanger cavity 104 is no longer exposed such that hanger 144 cannot be removed from hanger rod 142. As further illustrated in the cross-section of FIG. 10, hook-shaped portion 146 of hanger 144 is secured between hanger rod 142 and second retaining portion 132, while hooked portions 106 remain clipped to hanger rod 108. To remove hanger 144 from hanger rod 108, and/or to add additional hangers, hanger retainer 100 is shifted or rotated back to the first position.

In an embodiment not shown, hanger cavity 104 can be size adjustable for or adapted to secure differently sized or multiple hangers hooks. In one such embodiment, hanger cavity 104 can comprise a padded interior that snugly accepts hook-shaped portion 146 of hanger 144.

In another embodiment not shown, hanger retainer 100 can comprise a wide hanger cavity 104 for accepting more than one hanger 144. This would be especially useful when the multiple pieces of clothing hung on the multiple hangers are typically worn together, such as, for example, a matching suit blazer and suit pants.

In an embodiment not shown, hanger retainer 100 can include an attached light source and corresponding energy source so the user can better see the garments draped on the secured hanger in a darkened area. The light source can be a fluorescent light bulb or a light-emitting diode (LED). The energy source can be a battery or include an electrical cord to be connected to an electrical outlet.

Figure 11:
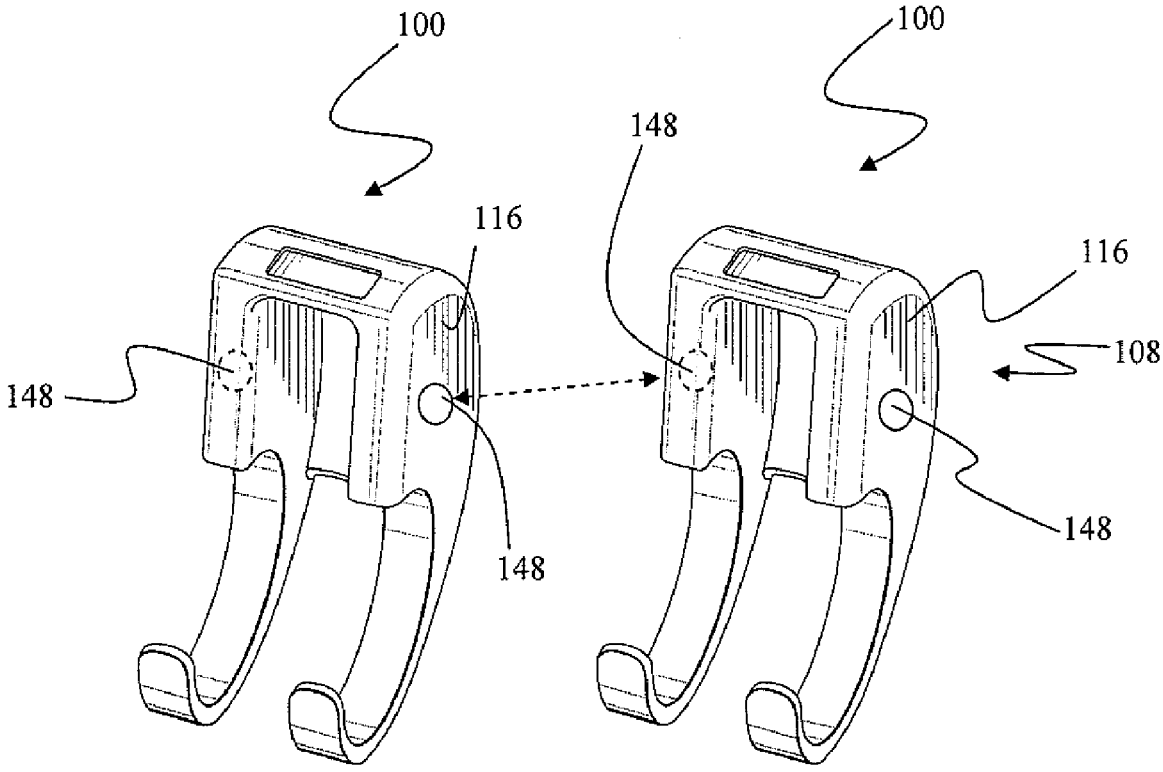
FIG. 11 is a perspective view of a hanger retainer with attachment means according to one embodiment of the invention.

In another embodiment depicted in FIG. 11, hanger retainer 100 can comprise attachment means 148 for attachment to adjacent hanger retainers. In one embodiment, attachment means 148 can comprise magnets. The magnets are on external faces 116 of side portions 108 such that the magnetic force of the magnet on a first hanger retainer 100 is attracted to the opposing magnetic force of a magnet on an external face of a second hanger retainer 100. In one embodiment, these magnets are rare earth-type magnets, such as neodymium magnets, samarium-cobalt magnets, ceramic magnets, or plastic magnets.

In an alternative embodiment, attachment means 148 can comprise a slideable fixation mechanism. A female member for receiving a male member is attached to external face 116 of first side portion 108*a* of first hanger retainer 100. A male member adapted to receive the female member is attached to external face 116 of second side portion 108*b*. The male member attached to an external face of a second hanger retainer 100 is then removably receivable within the female member of the first hanger retainer 100. Various other fixation methods can be used. The means for attaching hanger retainers is not limited to these embodiments. Those skilled in the art will appreciate that changes can be made in form and detail without departing from the spirit and scope.

In yet another embodiment not shown, hanger retainer 100 includes a rod-attachment means attached to the body portion 112 of hanger retainer 100. The rod-attachment means accepts a rod of a corresponding circumference and allows the user to attach multiple hanger retainers by use of the rod. The rod allows the user to quickly lock or unlock multiple hanger retainers at once.

In an embodiment not shown, hooked portions 106 can be size adjustable to accommodate garment-supporting rods of differing circumferences and/or different shapes. In another embodiment not shown, additional fastening means may be used to secure hanger retainer 100 around hook-shaped portion 146 of the hanger 144.

The invention may be embodied in other specific forms without departing from the essential attributes thereof; therefore, the illustrated embodiments should be considered in all respects as illustrative and not restrictive.

What is claimed is:

1. A hanger retaining device for retaining a hanger on a hanger rod, the hanger retaining device comprising:
- a first side portion spaced apart from an opposing second side portion, each side portion including:
  - a body portion presenting an external face and an internal face, the internal face being bound by an outer edge, and an arcuate inner edge spaced from the outer edge, the arcuate inner edge having a first end and a second end spaced apart along the arcuate inner edge, and
  - a hooked portion extending from at least one of the first and second side portions and presenting a continuing arcuate edge that extends from the arcuate inner edge along a continuing arcuate shape such that the arcuate inner edge and the continuing arcuate edge together define an arc greater than one hundred eighty degrees;
- a first retaining portion spaced radially outward from the first end of the arcuate inner edge of the internal face of each side portion by a first retaining distance, and extending between the internal face of the first side portion and the internal face of the second side portion; and
- a second retaining portion spaced radially outward from the second end of the arcuate inner edge of the internal face of each side portion by a second retaining distance, and extending between the internal face of the first side portion to the internal face of the second side portion, wherein the first retaining distance is greater than the second retaining distance;
- wherein the hooked portion is resilient and the arcuate shape is at a radial distance from a center point of the arc such that the arcuate inner edge and the hooked portion together are adapted to grippingly receive a hanger rod within.

2. The hanger retaining device of claim 1, wherein the hanger retaining device, when grippingly received on the hanger rod, is shiftable between a first position wherein a hook portion of a hanger is removably receivable on the hanger rod between the first side and the second side of the hanger retaining device, and a second position wherein the first retaining portion and the second retaining portion inhibit movement and removal of the hanger from the hanger rod.

3. The hanger retaining device of claim 2, wherein the first retaining distance is sufficient to provide a clearance between the hanger rod and the hook portion of a hanger to allow movement and removal of the hanger when the hanger retaining device is in the first position, and wherein the second distance is sufficient such that a clearance between the hanger rod and the hook portion is reduced to inhibit movement and removal of the hanger from the hanger rod.

4. The hanger retaining device of claim 1, wherein the arc defined by the arcuate inner edge and the continuing arcuate edge together is circular in shape and extends between two hundred ten and two hundred fifty degrees to sufficiently grip the hanger rod.

5. The hanger retaining device of claim 1, wherein a first hooked portion extends from the body portion of the first side portion and a second hooked portion extends from the body portion of the second side portion.

6. A hanger retaining system for retaining hangers on a hanger rod, the system comprising:
- a hanger rod;
- a hanger; and
- a hanger retaining device including:
  - a body portion comprising a first side portion and a second side portion spaced apart from each other, a hooked portion extending from at least one of the first and second side portions and grippingly positionable on the hanger rod, a first retaining portion spaced radially at a first retaining distance from the hanger rod and extending between the first and second side portions, and a second retaining portion spaced radially at a second retaining distance from the hanger rod and extending between the first and second side portions, wherein the first retaining portion is greater than the second retaining portion, the body portion presenting structure defining a cavity, the cavity being bound by the first and second side portions, the first and second retaining portions, and the hanger rod, wherein the hanger retaining device is shiftable between a first position in which the hanger is removably receivable within the cavity on the hanger rod, and a second position in which the hanger is retained on the hanger rod by the first retaining portion and the second retaining portion whereby lateral and vertical movement of the hanger on the hanger rod is inhibited.

7. The hanger retaining system of claim 6, wherein each side portion presents an external face and an internal face, the internal face being bound by an outer edge, and an arcuate inner edge spaced from the outer edge, the arcuate inner edge having a first end and a second end spaced apart along the arcuate inner edge; wherein the hooked portion presents a continuing arcuate edge that extends from the arcuate inner edge along a continuing arcuate shape such that the arcuate inner edge and the continuing arcuate edge together define an arc greater than one hundred eighty degrees; and wherein the hooked portion is resilient and the arcuate shape is of a sufficient size such that the arcuate inner edge and the hooked portion together can grippingly receive a hanger rod within.

8. The hanger retaining system of claim 7, wherein the arc defined by the arcuate inner edge and the continuing arcuate edge together is circular in shape and extends between two hundred ten and two hundred fifty degrees to sufficiently grip the hanger rod.

9. The hanger retainer system according to claim 7, wherein the cavity extends from about fifty to about ninety percent a total width of the body portion, the total width extending between the external faces of each side portion, and wherein the cavity extends from about fifty to about ninety percent a maximum total height of the body portion, the total height extending from a bottom edge to a top edge bounding each side portion.

10. The hanger retainer system according to claim 7, wherein the cavity is further bound by a rear panel extending between the side portions from the first retaining portion to the second retaining portion, the rear panel presenting a rear panel thickness.

11. The hanger retainer system according to claim 10, wherein the rear panel thickness is greater at the second retaining portion than the first retaining portion such that the cavity varies in depth from the first retaining portion to the second retaining portion.

12. The hanger retaining system of claim 6, wherein the hanger retaining device comprises two substantially parallel hooked portions, the first hooked portion extending from the first side portion, and the second hooked portion extending from the second side portion.

13. The hanger retainer system according to claim 6, wherein the hanger retaining device is shiftable between the first position and the second position via rotation about a longitudinal axis of the hanger rod.

14. A method of retaining a hanger on a hanger rod, the method comprising:

providing a hanger retaining device comprising a body portion comprising a first side portion and a second side portion spaced apart from each other, a hooked portion extending from at least one of the first and second side portions and grippingly positionable on a hanger rod, a first retaining portion spaced radially at a first retaining distance from an inner edge of each side portion and extending between the first and second side portions, and a second retaining portion spaced radially at a second retaining distance from the inner edge of each side portion, and extending between the first and second side portions, wherein the first retaining distance is greater than the second retaining distance, the body portion presenting structure defining a cavity, the cavity being bound by the first and second side portions, and the first and second retaining portions;

positioning the hanger retaining device on a hanger rod by the hooked portion such that the cavity is further bound by the hanger rod;

inserting a hook-shaped portion of a hanger into the cavity and onto the hanger rod; and shifting the hanger retaining device from a first position in which the hanger is removably receivable within the cavity on the hanger rod, to a second position in which the hanger is retained on the hanger rod by the first retaining portion and the second retaining portion whereby lateral and vertical movement of the hanger on the hanger rod is inhibited.

15. The method of claim 14, wherein shifting the hanger retaining device from the first position to the second position comprises rotating the hanger retaining device in a first direction about a longitudinal axis of the hanger rod.

16. The method of claim 14, further comprising:

shifting the hanger retaining device from the second position to the first position; and removing the hanger from the hanger rod.

17. The method of claim 16, wherein shifting the hanger retaining device from the second position to the first position comprises rotating the hanger retaining device in a second direction opposite the first direction about the longitudinal axis of the hanger rod.

18. The method of claim 14, further comprising:

transporting the hanger rod containing the hanger secured thereto, wherein the hanger remains secured to the hanger rod during transport.

19. The method of claim 14, wherein each side portion of the hanger retaining device presents an external face and an internal face, the internal face being bound by an outer edge, and an arcuate inner edge spaced from the outer edge, the arcuate inner edge having a first end and a second end spaced apart along the arcuate inner edge; wherein the hooked portion presents a continuing arcuate edge that extends from the arcuate inner edge along a continuing arcuate shape such that the arcuate inner edge and the continuing arcuate edge together define an arc greater than one hundred eighty degrees; and wherein the hooked portion is resilient and the arcuate shape is of a sufficient size such that the arcuate inner edge and the hooked portion together can grippingly receive a hanger rod within.

20. The method of claim 19, wherein the arc defined by the arcuate inner edge and the continuing arcuate edge together is circular in shape and extends between two hundred ten and two hundred fifty degrees to sufficiently grip the hanger rod, and wherein shifting of the hanger retaining device from the first position to the second position comprises rotating the hanger retaining device about ninety degrees about the hanger rod.

* * * * *